US006494007B1

(12) United States Patent
Gembala

(10) Patent No.: US 6,494,007 B1
(45) Date of Patent: Dec. 17, 2002

(54) EXPANSION JOINT CURB FOR ROOF SYSTEMS

(76) Inventor: Henry Gembala, 18108 Clearbrook Cir., Boca Raton, FL (US) 33498

( * ) Notice: Subject to any disclaimer, the term of this patent is extended or adjusted under 35 U.S.C. 154(b) by 0 days.

(21) Appl. No.: 09/693,296

(22) Filed: Oct. 20, 2000

Related U.S. Application Data

(62) Division of application No. 09/177,846, filed on Oct. 22, 1998, now Pat. No. 6,237,293.

(51) Int. Cl.[7] ..... E04D 1/36

(52) U.S. Cl. ..... 52/395; 52/396.02; 52/396.04; 52/416; 52/461; 52/573.1

(58) Field of Search ..... 52/393 B, 395, 52/396.04, 396.08, 396.1, 402, 396.02, 573.1, 461, 466, 467, 465, 416

(56) References Cited

U.S. PATENT DOCUMENTS 3,296,762 A * 1/1967 Thom
3,343,323 A * 9/1967 Mayfield
3,831,506 A * 8/1974 Landheer ..... 98/41
3,964,220 A * 6/1976 Rutkowski et al. ..... 52/100
4,005,555 A * 2/1977 Roth et al. ..... 52/60
4,893,448 A * 1/1990 McCormick ..... 52/396
5,197,250 A * 3/1993 Kramer ..... 52/396
5,272,846 A * 12/1993 Kelley et al. ..... 52/96

* cited by examiner

*Primary Examiner*—Yvonne M. Horton
(74) *Attorney, Agent, or Firm*—Robert M. Downey

(57) ABSTRACT

An expansion joint curb assembly includes one or more pre-formed component structures fabricated from a non-corrosive, durable material. Each of the component structures include an anchoring flange for attachment to the roof structure, an upper flange defining a mounting base for attachment of various roofing components, such as expansion joint covers thereto, and an intermediate portion between the anchoring flange and the upper flange. The intermediate portion is provided with vent holes for venting gasses and moisture which accumulate within the roof structure, thereby reducing the likelihood of premature roof failure.

5 Claims, 2 Drawing Sheets

EXPANSION JOINT CURB FOR ROOF SYSTEMS

This application is a divisional patent application of patent application Ser. No. 09/177,846 filed on Oct. 22, 1998, now U.S. Pat. No. 6,237,293 B1 issue May 29, 2001.

BACKGROUND OF THE INVENTION

1. Field of the Invention

The present invention relates to blocking for use in roof systems and, more particularly, to an expansion joint curb comprising one or more preformed, uniform component structures fabricated from a non-corrosive, durable material, such as galvanized steel, steel, aluminum or plastic and including a lower anchoring flange for attachment to the roof structure, a central portion including vent means formed therein, and an upper flange defining a mounting surface for attachment to various roof components and equipment thereto.

2. Description of the Related Art

Generally, roof systems used on most building structures, and particularly commercial buildings, require some type of blocking to provide a base for the attachment of roofing components such as, but not limited to, gravel stops, eves, drips, fascia, gutters, vent stacks, roof top equipment, expansion joints, roof curbs, copings and cant strips. Traditionally, wood is used for roof blocking and typically consists of one or more stacked wood boards (e.g., 2 inch by 4 inch or 2 inch by 6 inch boards) which are nailed to the roof structure and each other to provide a built-up base at various locations on the roof system wherein it is necessary to mount the roofing components and equipment. Presently, wood blocking is used on virtually all roof systems which require blocking for the purposes described above.

Despite its widespread use in roof systems, there are significant drawbacks and shortcomings associated with the use of conventional wood blocking. In particular, wood is susceptible to damage and deterioration from moisture, termites, ants, and other natural enemies. Further, because wood is a solid material, it does not provide for venting capabilities to permit escape of moisture and gasses from within the roof. The lack of adequate venting is a contributing factor of premature roof failure. Additionally, wood has limited pull-out characteristics for holding nails and other fasteners, thereby requiring a considerable amount of hardware to attach roofing components. Wood, being a natural product, is also prone to irregularities such as areas of reduced dimension, warping, and splintering. This makes it difficult, if not impossible, to achieve a straight, uniform blocking configuration. Furthermore, the dimensions of wood are limited to lumber industry standards which often does not correspond to the dimensions of roofing components, such as roof insulation or lightweight concrete thickness, expansion joint heights and equipment sizes.

In view of the shortcomings of traditional wood blocking used in roof systems, as set forth above, there exists an urgent need in the construction industry for an alternative blocking structure which overcomes the above-described problems. More specifically, there is a need for a blocking assembly which provides for uniform dimensions in accordance with desired size and configuration specifications and which further provides for venting of the roof system. Additionally, there is a need for a roof blocking system which significantly reduces costs for labor and materials associated with the installation of blocking and the attached roofing components.

SUMMARY OF THE INVENTION

The present invention is directed to a blocking assembly for roof systems and replaces traditional wood blocking which is currently used on building structures to facilitate the attachment of various roofing components, materials and equipment including, but not limited to, expansion joints and covers (flat type, curb type, or curb to wall).

The blocking system includes one or more components which are preformed in accordance with desired size and shape specifications. The components, fabricated from galvanized steel, steel, aluminum, plastic or other non-corrosive, durable materials, each including an anchoring flange, an upper flange and intermediate portion. The anchoring flange is structured and disposed for mating attachment to the roof structure underlying an insulation layer or lightweight concrete layer on the roof system. The intermediate portion extends upwardly from the anchoring flange. The upper flange extends from the intermediate portion and defines a mounting base for attachment of an expansion joint cover or other roofing components, materials and/or equipment thereto. Vent means are provided in the intermediate portion to allow escape of moisture and gasses which otherwise remain trapped within the roof system. This helps to reduce the likelihood of premature roof failure, and thereby extends the life of the roof system.

OBJECTS AND ADVANTAGES OF THE INVENTION

With the foregoing in mind, the present invention has the following objects and advantages over the conventional wood blocking structure presently used in most roof systems.

It is particularly, a primary object of the present invention is to provide a blocking assembly for roof systems comprising one or more pre-formed components manufactured from galvanized steel, steel, aluminum, plastic or other corrosion-resistant materials to replace traditional wood blocking and thereby providing resistance to deterioration from moisture, insects, warping, and the like.

It is a further object of the present invention to provide a blocking assembly comprising one or more components which are formed and/or molded in accordance with desired size and configuration specifications for use at specific locations of a roof system.

It is still a further object of the present invention to provide a blocking assembly having a pullout resistance which is significantly greater than that of wood, thereby requiring less hardware, labor and materials to install the blocking and attached roofing materials.

It is yet a further object of the present invention to provide a blocking assembly which is pre-formed and fabricated to conform to a roof structure.

It is still a further object of the present invention to provide a blocking assembly for roof systems which includes venting means for allowing moisture and gasses to be released from the roof assembly, thereby reducing the likelihood of premature roof failure.

It is still a further object of the present invention to provide a blocking assembly for roof systems and, more particularly, an expansion joint curb for use at an expansion joint of a roof system and including means for attachment of an expansion joint cover thereto.

It is still a further object of the present invention to provide one or more integral components fabricated from a non-corrosive, durable material for forming an expansion joint curb at an expansion joint of a roof system which, once installed, becomes integrated with the roof structure.

It is still a further object of the present invention to provide an expansion joint curb assembly for roof systems which is less expensive than wood materials traditionally used for constructing expansion joint curbs.

BRIEF DESCRIPTION OF THE DRAWINGS

For a fuller understanding of the nature of the present invention, reference should be made to the following detailed description taken in conjunction with the accompanying drawings in which.

Like reference numerals refer to like parts throughout the several views of the drawings.

DETAILED DESCRIPTION OF THE PREFERRED EMBODIMENTS

Figure 1:
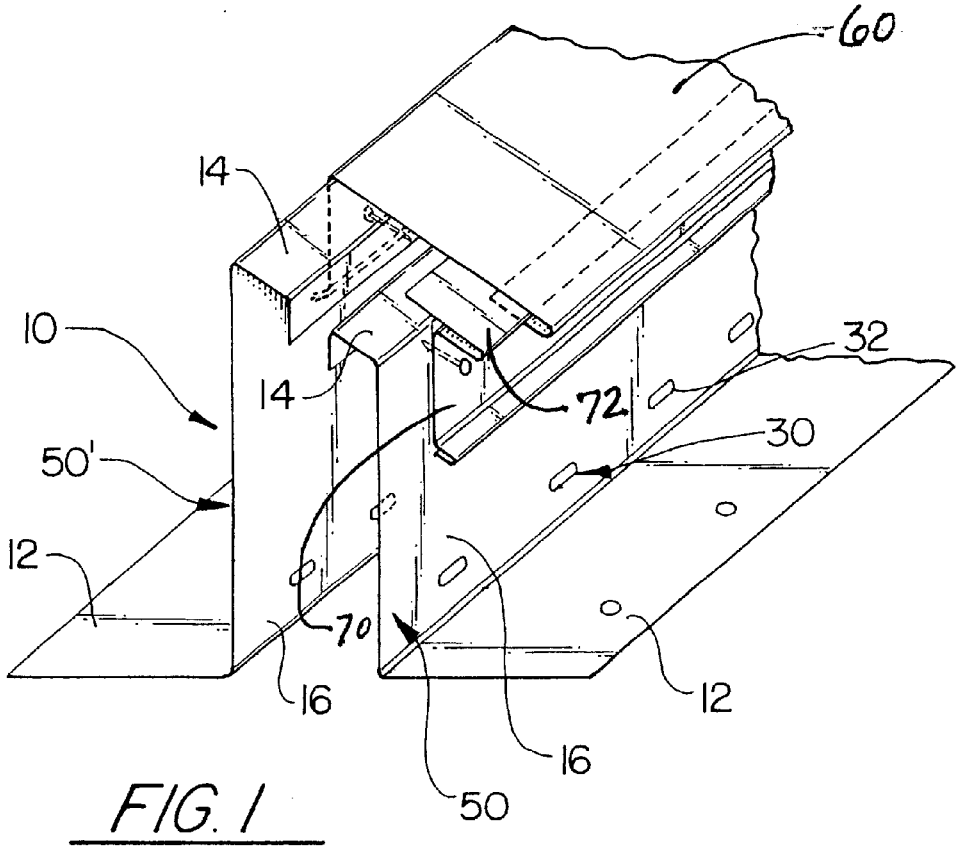
FIG. 1 is an isolated perspective view of one embodiment of the invention showing an expansion joint curb assembly including two opposing components for installation at an expansion joint of a roof system and the attachment of an expansion joint cover thereto.
Figure 2:
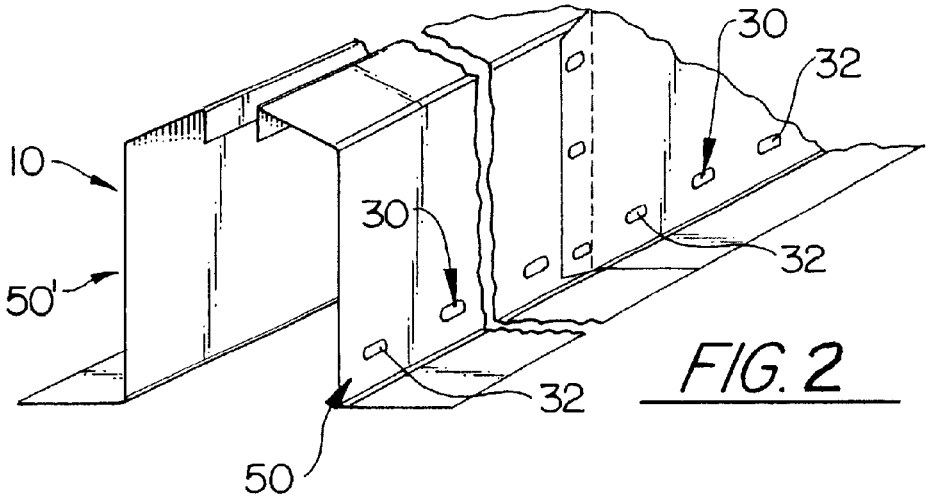
FIG. 2 is a partial perspective view of another embodiment of the expansion joint curb assembly.

FIGS. 1–5 illustrate various exemplary embodiments of a blocking assembly for use on roof systems, and more particularly to an assembly for constructing an expansion joint curb and having means for attaching an expansion joint cover thereto. Throughout the several figures of the drawings, the expansion joint curb assembly is shown to embody various embodiments thereof. In each of these embodiments, the expansion joint curb assembly is generally indicated as 10. It should be noted that the present invention is applicable in building construction configurations other than those shown for purposes of illustration in the drawings, and is generally intended to replace conventional wood blocking at all locations wherein it is necessary to provide a built-up base or curb for the attachment of roofing components, materials and equipment including expansion joints and covers (e.g., flat type, curb type, or curb to wall).

The components 50, 50' of the expansion joint curb assembly 10 of the several embodiments shown throughout the drawing figures are formed as an integral unit. Each component 50, 50' of the curb assembly includes an anchoring flange 12, an upper flange 14, and an intermediate plate 16 extending between the anchoring flange 12 and upper flange 14. The anchoring flange 12 preferably extends from the bottom edge of the intermediate plate 16 a sufficient distance to provide a stable surface area for mating, anchoring attachment to the roof structure adjacent to an expansion joint of the roof system. In use, the anchoring flange 12 is attached to the roof slab 22, which is typically a concrete substrate. A drive anchor with removable pin may be used to secure the anchoring flange 12 to the roof slab. Alternatively, concrete nails or other well known anchoring hardware may be used for this purpose.

In each of the above described embodiments, the blocking assembly 10 is further provided with vent means 30 for allowing moisture and gasses to be released from the roof assembly. In particular, the vent means 30 allow moisture and gasses which may accumulate during the installation and setting of lightweight insulation concrete or other insulative material. The release of gasses and moisture via the vent means serves to reduce the likelihood of premature roof failure. In the various embodiments shown throughout the drawings, the vent means comprises a plurality of apertures 32 formed through the thickness of intermediate plate portion 16 at spaced intervals along a length thereof. The apertures may be in the form of circular holes or elongate slots.

Figure 3:
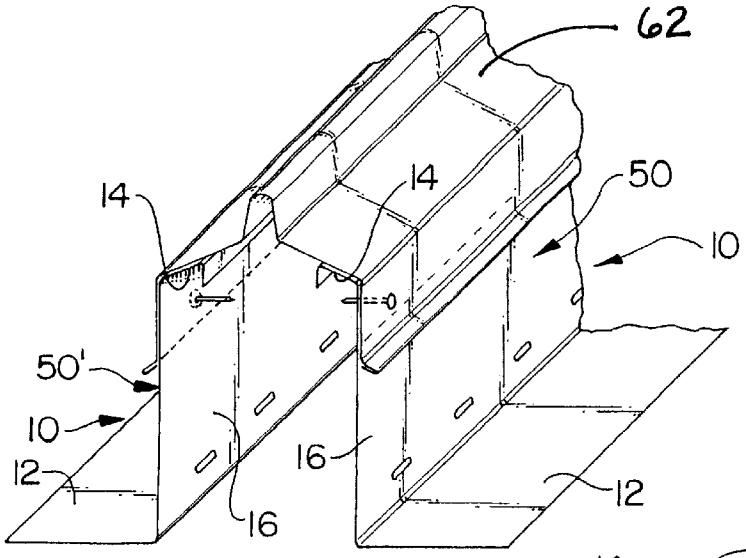
FIG. 3 is a partial perspective view of the expansion joint curb assembly of FIG. 2 shown with the opposing components an expansion joint cover attached thereto.
Figure 4:
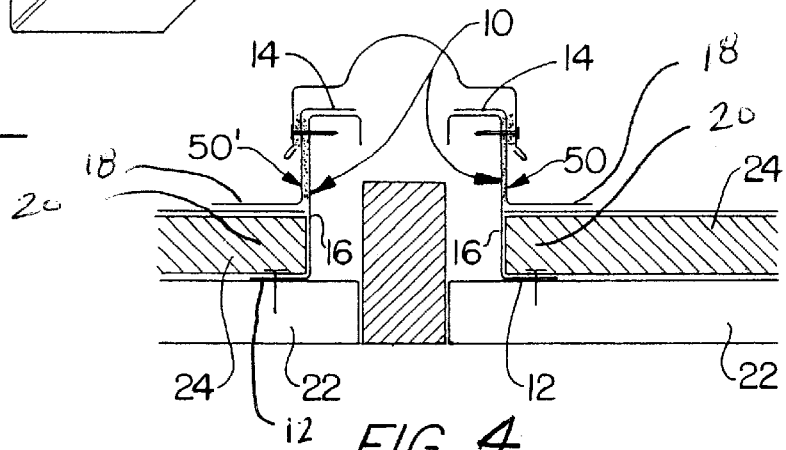
FIG. 4 is a sectional view illustrating another embodiment of the invention comprising a curb type expansion joint assembly having a flat upper flange perpendicular to the intermediate portion and an insulation receiving portion.

FIGS. 1, 3 and 4 illustrate various embodiments of the expansion joint curb components 50, 50' positioned in opposing relation to facilitate attachment of an expansion joint cover. In the three different embodiments of FIGS. 1, 3 and 4, respectively, the components 50, 50' of the curb assembly 10 are positioned in spaced apart opposing relation to one another on opposite sides of an expansion joint in the roof system so that a gap remains between the upper flanges 14. As seen in FIG. 4, the anchoring flange 12 of each component 50, 50' is attached to the roof slab, as described above. In each embodiment, the upper flange extends outwardly from an opposite face of the intermediate plate portion, so that each component has a generally Z configuration.

FIG. 1 illustrates a first embodiment of the expansion joint curb assembly 10 for installation at an expansion joint on a roof system. The expansion joint curb assembly 10 is structured for attachment of an expansion joint cover 60 thereto. More particularly, the expansion joint curb assembly 10 includes two opposing components 50, 50', each comprising the anchoring flange 12, upper flange 14, and intermediate plate portion 16. The vent means 30 in the form of elongate holes or slots are provided in the intermediate plate portion of each of the components 50, 50', near the anchoring flange. The two components 50 and 50' are positioned in opposing relation to each other on opposite sides of an expansion joint. In this embodiment, the intermediate plate 16 of component 50' extends higher than the intermediate plate 16 of component 50 so that the opposing upper flanges 14 of the two components are angled, as shown. A bracket 70 is fastened to component 50 to provide a lip 72 for moveable attachment of the expansion joint cover 60 thereto and in covering relation to the opposing upper flanges 14 and the gap therebetween.

An area of depth 20 is defined between the anchoring flange and a central flange 18 along an outer face of the intermediate plate portion. As seen in FIG. 4, roof insulation material 24 is applied in covering relation to the anchoring flange within the area of depth 20 on the outer face of the intermediate plate portion and between the anchoring flange 12 and the central flange 18.

Figure 5:
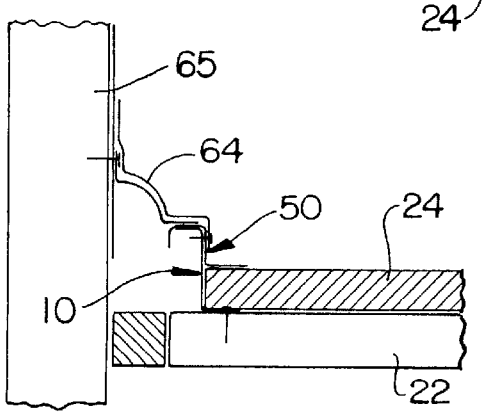
FIG. 5 is a sectional view of the embodiment of FIG. 4 shown with one component used at a wall expansion joint to encapsulate the roof insulation and to facilitate attachment of a wall expansion joint cover.

In FIG. 5, only one of the curb components 50 is used at a wall expansion joint to facilitate attachment of a wall expansion joint cover 64 to the upper flange and intermediate plate portion as well as to a vertical wall structure 65 adjacent the roof slab.

It should be noted that in each of the above described embodiments of the blocking assembly 10 of the present invention, the components 50 and 50', including anchoring flange 12, intermediate flange portion 16, and upper flange 14, are preferably formed as an integral unit from galvanized steel, steel, aluminum, plastic or other non-corrosive, durable materials. The integral unit may be formed by various forming and molding methods well known in the industry including bending, roll forming, extrusion molding, injection molding and vacuum molding.

While the instant invention has been shown and described in accordance with preferred and practical embodiments thereof, it is recognized that departures may be made from the instant disclosure which, therefore, should not be limited except as set forth in the following claims as interpreted under the doctrine of equivalents.

What is claimed is:

1. A blocking assembly for attachment to a roof structure of a building including roofing materials and components of the roof structure having a top surface and a slab with a top surface, the blocking assembly being structured to facilitate installation of an expansion joint cover, said blocking assembly comprising:

at least one integral component unit including:

an anchoring flange structured and disposed for attachment to the top surface of the slab of the roof structure;

an upper flange disposed in spaced relation above said anchoring flange;

a central flange extending in spaced, parallel relation to said anchoring flange to define an open mouth therebetween, said open mouth being sized and configured to accommodate roof insulation of light-weight concrete between said anchoring flange and said central flange;

an intermediate portion extending vertically between said anchoring flange and said upper flange;

said upper flange and said intermediate portion forming a curb extending upwardly above the top surface of the roof structure and being structured and disposed for attaching the roofing materials and components thereto;

vent means formed in said intermediate portion and including a plurality of apertures provided at spaced intervals along said intermediate portion for venting moisture and gases from within said roof structure; and means for attachment of the expansion joint cover to said at least one component unit.

2. The blocking assembly as recited in claim 1 wherein said integral component unit is formed of galvanized steel.

3. The blocking assembly as recited in claim 1 wherein said integral component unit is formed of steel.

4. The blocking assembly as recited in claim 1 wherein said integral component unit is formed of aluminum.

5. The blocking assembly as recited in claim 1 wherein said integral component unit is formed of plastic.

* * * * *